US012486985B2

(12) United States Patent
Cadima

(10) Patent No.: US 12,486,985 B2
(45) Date of Patent: Dec. 2, 2025

(54) GAS BURNER ASSEMBLY AND COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 300 days.

(21) Appl. No.: 18/295,594

(22) Filed: Apr. 4, 2023

(65) Prior Publication Data

US 2024/0337388 A1 Oct. 10, 2024

(51) Int. Cl.
*F24C 3/08* (2006.01)
*F23D 14/06* (2006.01)

(52) U.S. Cl.
CPC ..... *F24C 3/085* (2013.01); *F23D 14/06* (2013.01)

(58) Field of Classification Search
CPC .. F24C 3/08; F24C 3/082; F24C 3/085; F23D 14/06
USPC ..... 126/39 R, 39 E
See application file for complete search history.

(56) References Cited

U.S. PATENT DOCUMENTS

| | | | | |
|---|---|---|---|---|
| 2,661,057 | A * | 12/1953 | Resek | F23D 14/06 239/524 |
| 9,151,494 | B2 | 10/2015 | Quintaba' et al. | |
| 9,541,294 | B2 | 1/2017 | Angulo | |
| 10,605,461 | B2 | 3/2020 | Cadima | |
| 10,731,851 | B2 | 8/2020 | Angulo | |
| 2004/0072112 | A1* | 4/2004 | Harneit | F24C 3/085 431/354 |
| 2008/0202494 | A1 | 8/2008 | Paesanti | |
| 2015/0040887 | A1 | 2/2015 | Angulo | |

FOREIGN PATENT DOCUMENTS

| | | | | |
|---|---|---|---|---|
| CN | 202494111 U | * | 10/2012 | F23D 14/64 |
| CN | 203349269 U | | 12/2013 | |
| EP | 0634608 A2 | | 1/1995 | |
| WO | WO2020173204 A1 | | 9/2020 | |

* cited by examiner

*Primary Examiner* — Vivek K Shirsat
(74) *Attorney, Agent, or Firm* — Dority & Manning, P.A.

(57) ABSTRACT

A cooktop appliance and a gas burner assembly are provided. The gas burner assembly is positioned at a top panel and includes an annular burner body positioned at a top surface of the top panel. The annular burner body forms a central combustion zone, a plurality of flame ports at the central combustion zone, and an annular mixing chamber upstream from the plurality of flame ports to permit a fuel-air mixture to flow into the central combustion zone through the plurality of flame ports. An annular burner base forms a bottom wall of the mixing chamber and an annular burner head forms a top wall of the mixing chamber. A puck including a domed projection separably positioned at the top surface of the top panel and extending toward the central combustion zone.

20 Claims, 14 Drawing Sheets

GAS BURNER ASSEMBLY AND COOKTOP APPLIANCE

FIELD

The present subject matter relates generally to cooktop appliances with gas burner assemblies, such as gas range appliances or gas stove appliances.

BACKGROUND

Certain cooktop appliances include gas burners for heating cooking utensils on the cooktop appliances. Gas burners that fire inwards, typically with a swirling flame pattern, offer better efficiency than traditional outward firing gas burners. Inward fired burners typically include round, concentric inner and outer walls that are typically larger in diameter than those of outward fired burners.

Inward fired burners often exhibit an undesirable noise or "poof" when gaseous fuel is being ignited. The noise may result from a pooling of gaseous fuel, such as may occur when there is a delay in igniting the fuel. For instance, such delays may occur when a user turns a control valve to allow gas to flow but passes an ignition position and then returns to the ignition position to ignite the gases that accumulated since the control valve opened and allowed gas to flow.

Automatic ignition systems may quickly provide a spark before gas is allowed to pool, which may mitigate undesirable noises of the gaseous fuel ignition. However, such systems are costly.

Structures may be provided that may dissipate fuel and mitigate the ignition noise. However, such structures may have limited effectiveness and may face similar cost issues as automatic ignitions systems. Still further, such structures may have structural limitations that limit how much heat can be received by the structure and how effective the ignition noise may be mitigated.

Accordingly, it would be beneficial and advantageous to provide a cooktop appliance and burner assembly that reduces or eliminates ignition noise. Furthermore, it would be beneficial and advantageous to provide a cooktop appliance and burner assembly that reduces or eliminates ignition noise and can receive greater heat loads.

BRIEF DESCRIPTION

Aspects and advantages of the invention will be set forth in part in the following description, or may be obvious from the description, or may be learned through practice of the invention.

An aspect of the present disclosure is directed to a cooktop appliance including a top panel and a gas burner assembly positioned at the top panel. The gas burner assembly includes an annular burner body positioned at a top surface of the top panel. The annular burner body forms a central combustion zone, a plurality of flame ports at the central combustion zone, and an annular mixing chamber upstream from the plurality of flame ports to permit a fuel-air mixture to flow into the central combustion zone through the plurality of flame ports. An annular burner base forms a bottom wall of the mixing chamber and an annular burner head forms a top wall of the mixing chamber. A puck including a domed projection separably positioned at the top surface of the top panel and extending toward the central combustion zone.

Another aspect of the present disclosure is directed to a gas burner assembly for a cooktop appliance. The gas burner assembly includes an annular burner body positioned at a top surface of a top panel of the cooktop appliance. The annular burner body forms a central combustion zone, a plurality of flame ports at the central combustion zone, and an annular mixing chamber upstream from the plurality of flame ports to permit a fuel-air mixture to flow into the central combustion zone through the plurality of flame ports. An annular burner base forms a bottom wall of the mixing chamber and an annular burner head forms a top wall of the mixing chamber. A puck including a domed projection separably positioned at the top surface of the top panel and extending toward the central combustion zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
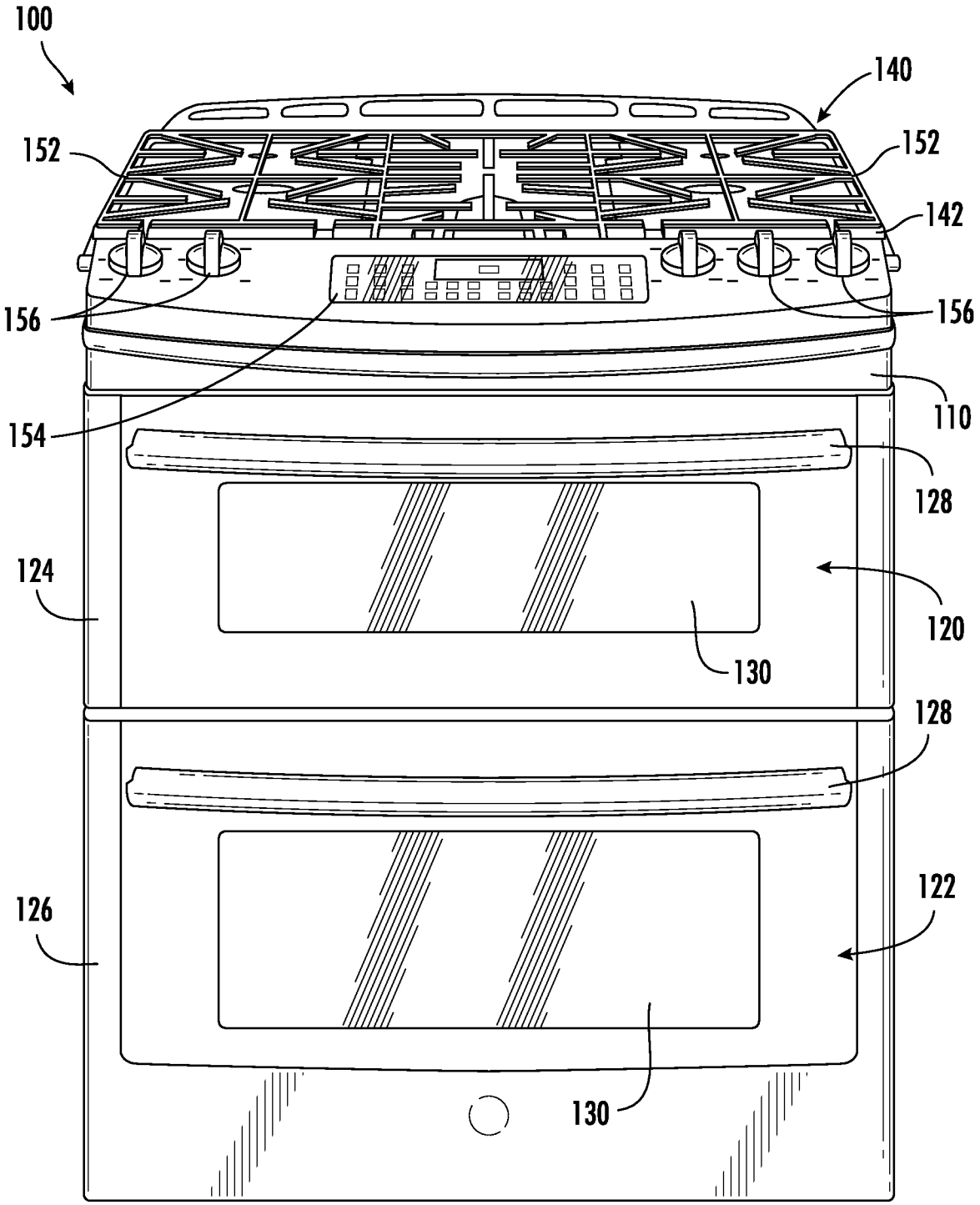
FIG. 1 provides a front, perspective view of a range appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
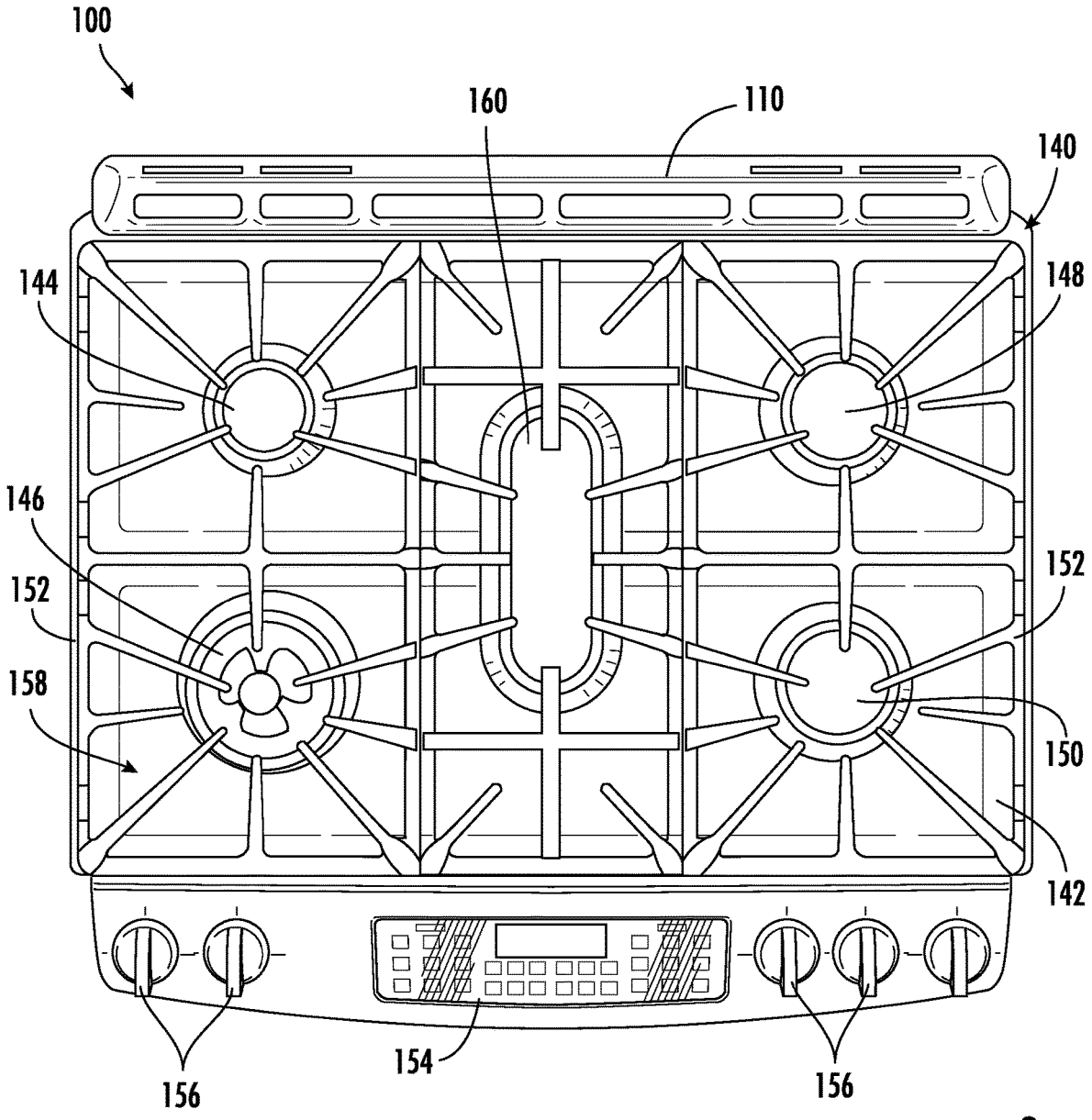
FIG. 2 provides a top, plan view of the exemplary range appliance of FIG. 1.
Figure 3:
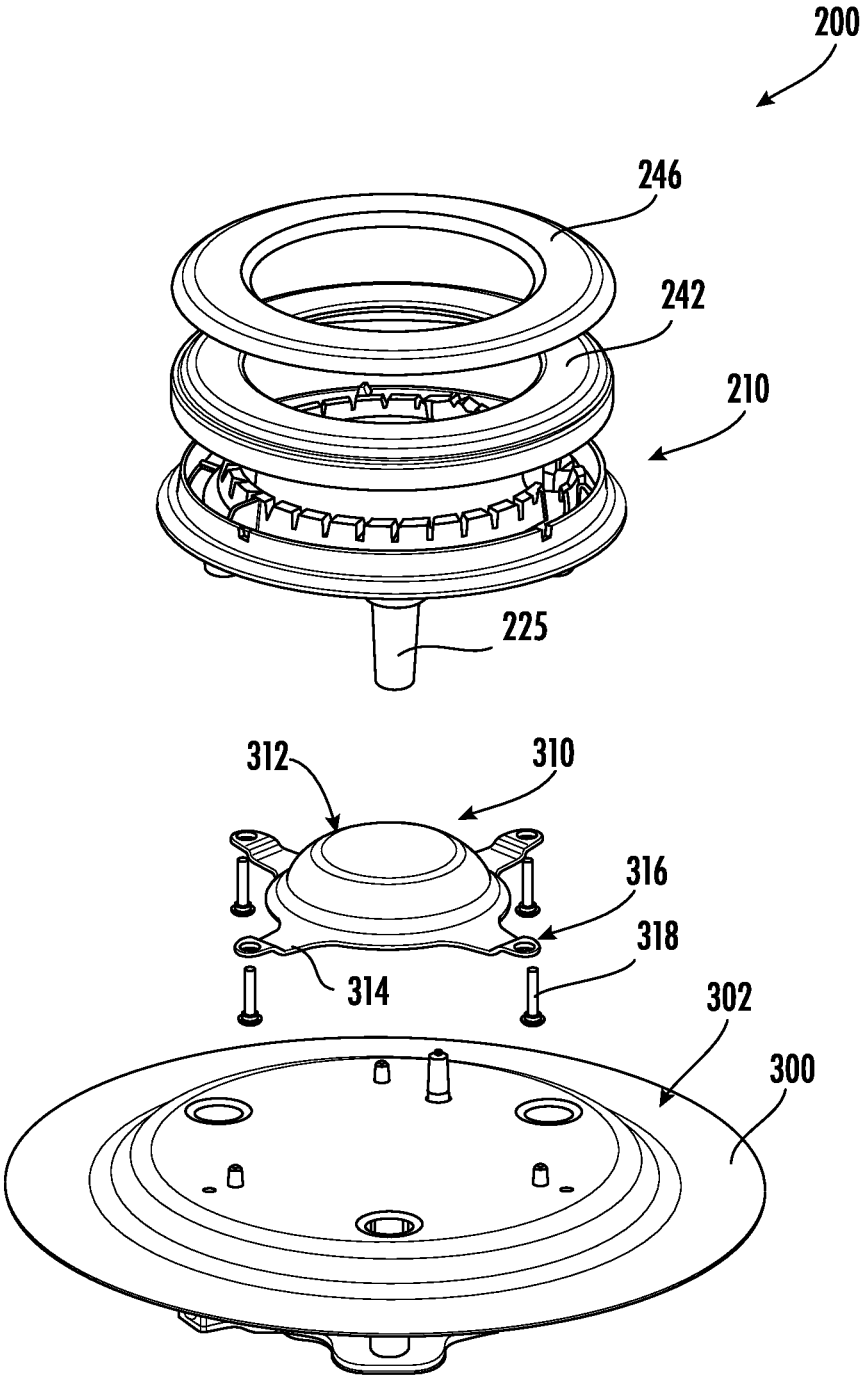
FIG. 3 provides an exploded perspective view of an embodiment of a burner assembly according to an exemplary embodiment of the present disclosure.
Figure 4:
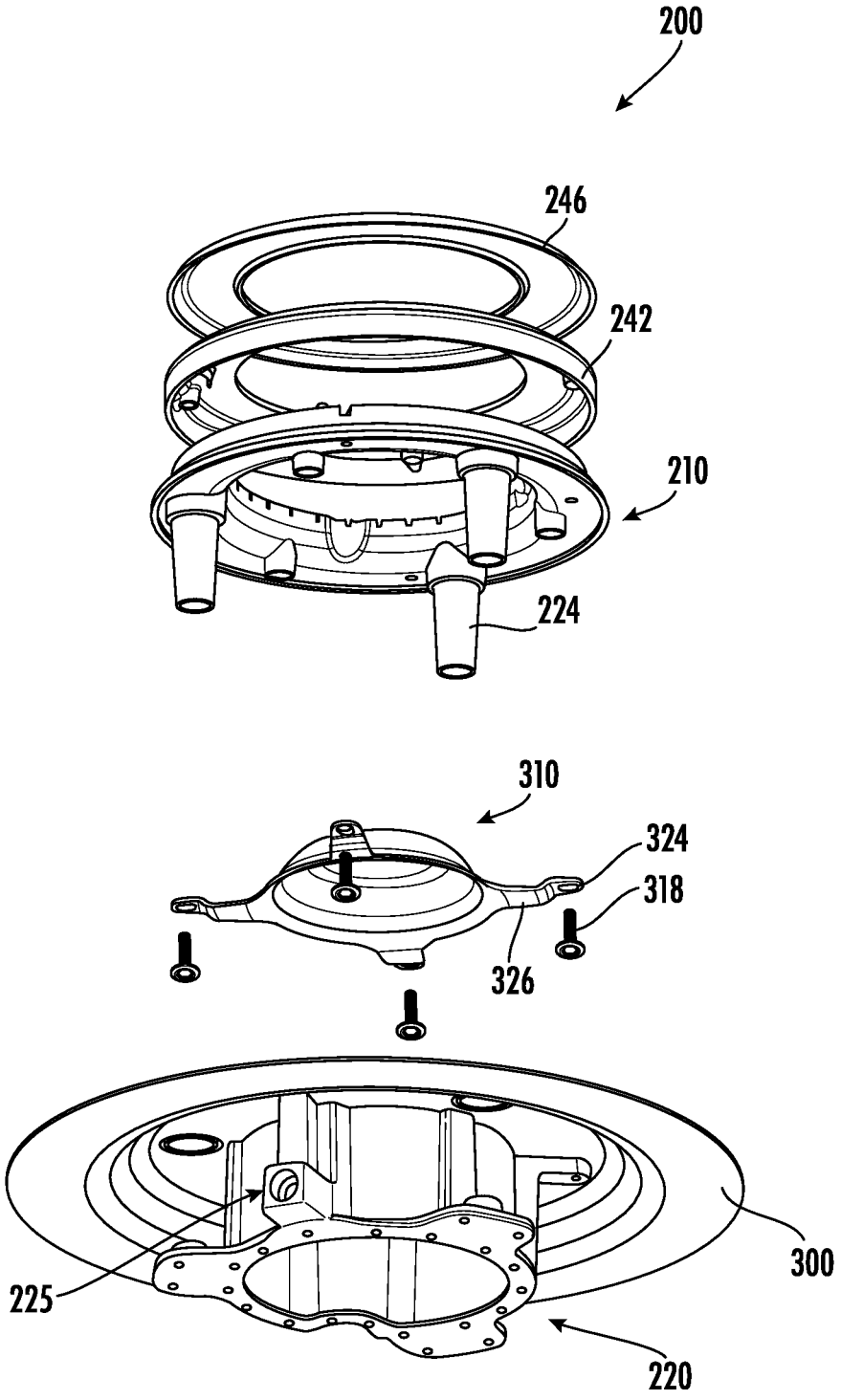
FIG. 4 provides an exploded perspective view of an embodiment of a burner assembly according to an exemplary embodiment of the present disclosure.
Figure 5:
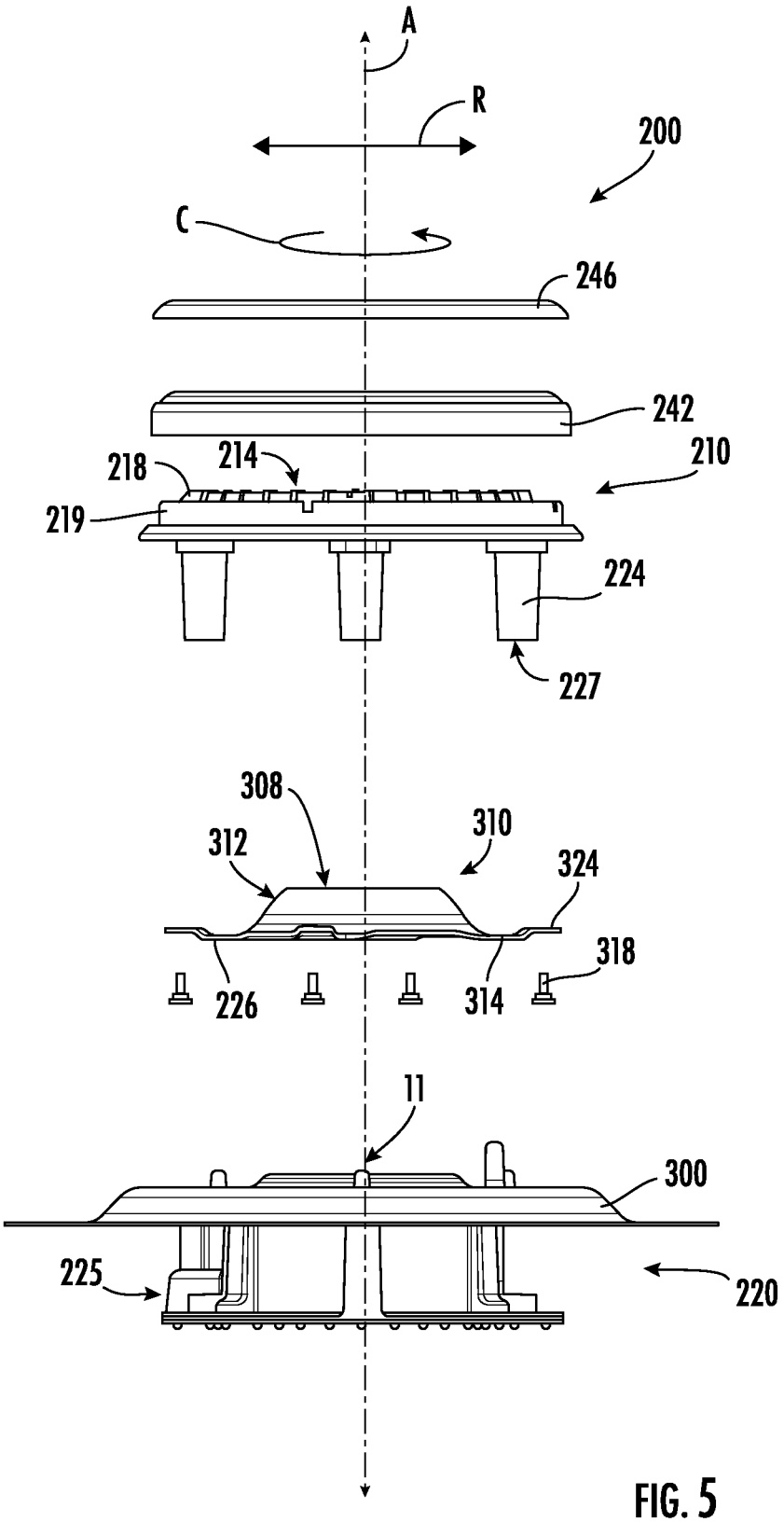
FIG. 5 provides an exploded side view of an embodiment of a burner assembly according to an exemplary embodiment of the present disclosure.
Figure 6:
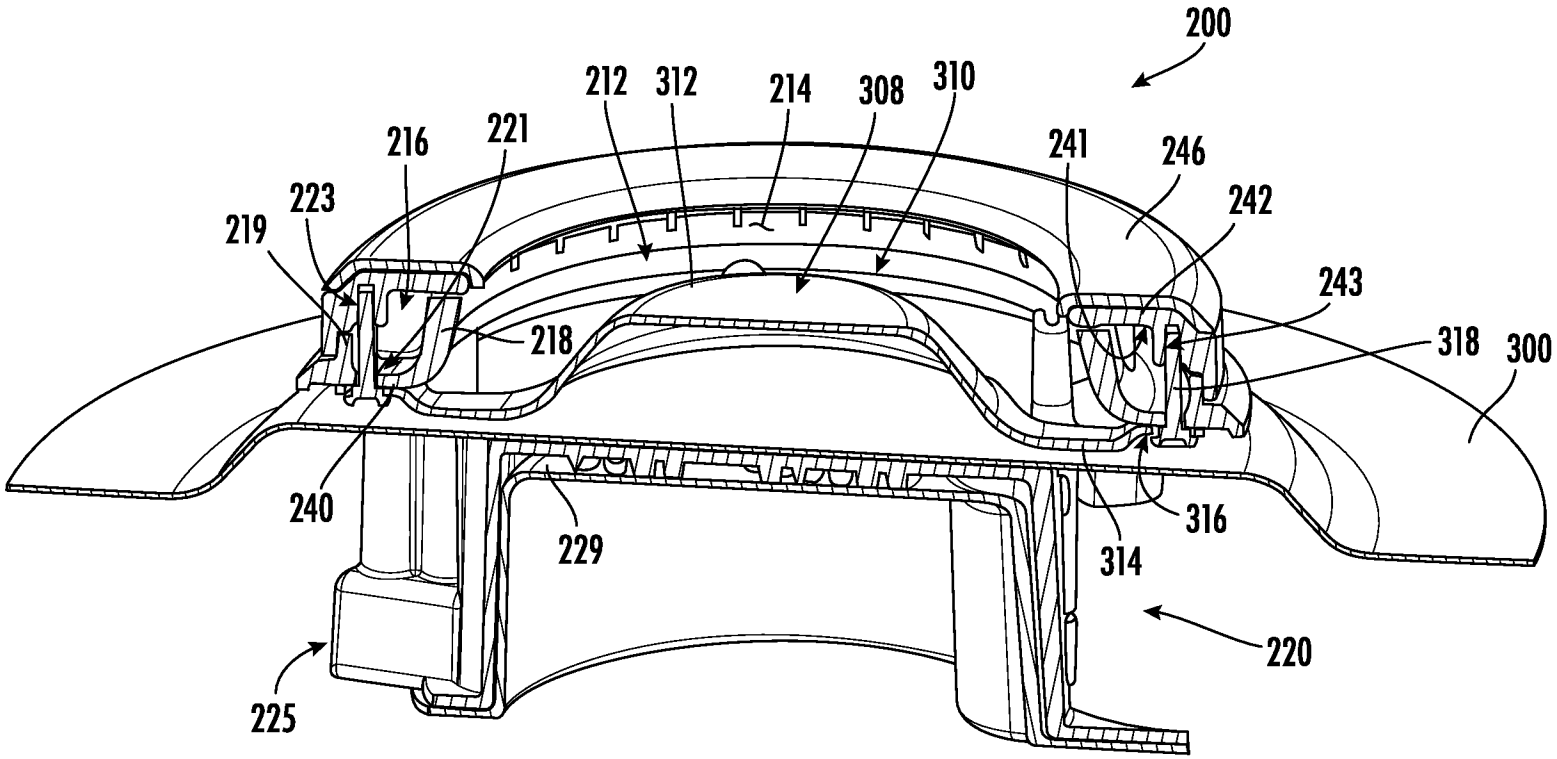
FIG. 6 provides a cutaway perspective view of an embodiment of a burner assembly according to an exemplary embodiment of the present disclosure.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3-11, various views are provided of a gas burner assembly 200 according to an exemplary embodiment of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments.

Generally, burner assembly 200 defines an axial direction A, a radial direction R, and a circumferential direction C. A reference centerline axis 11 is depicted extending through the burner assembly 200, from which axial direction A, radial direction R, and circumferential direction C may be extended.

Burner assembly 200 includes an annular burner body 210. Annular burner body 210 defines a central combustion zone 212. Annular burner body 210 also defines a plurality of flame ports 214 (e.g., at or facing central combustion zone 212). Flame ports 214 may be distributed, for example, along the circumferential direction C, about central combustion zone 212. Gaseous fuel is flowable from a mixing chamber 216 within annular burner body 210 into central combustion zone 212 through flame ports 214. Flame ports 214 may also be oriented such that the gaseous fuel flows in a swirling pattern from flame ports 214 into central combustion zone 212.

In various embodiments, burner assembly 200 is configured as inward firing with a swirling flame pattern. Annular burner body 210 includes an inner side wall 218 and an outer side wall 219. Inner side wall 218 may extend around central combustion zone 212 (e.g., along the circumferential direction C). Flame ports 214 may be formed on or extend through inner side wall 218 (e.g., along the radial direction R, between mixing chamber 216 and central combustion zone 212). Outer side wall 219 may extend around inner side wall 218 (e.g., along the circumferential direction C). Outer side wall 219 may also be spaced from inner side wall 218 (e.g., along the radial direction R). Mixing chamber 216 may be defined and positioned between inner and outer side walls 218, 219 (e.g., along the radial direction R, within annular burner body 210). Annular burner body 210 is open at central combustion zone 212. For example, no portion or component of annular burner body 210 may extend (e.g., inward or otherwise along the radial direction R) into central combustion zone 212. In some embodiments, no fuel-providing structure extends into the central combustion zone 212.

Burner assembly 200 also includes a fuel manifold 220. Fuel manifold 220 is positioned beneath burner body 210 (e.g., along axial direction A). Annular burner body 210 is fluidly coupled to fuel manifold 220 upstream from mixing chamber 216 such that the gaseous fuel is flowable from fuel manifold 220 into mixing chamber 216 of annular burner body 210. For example, fuel manifold 220 has an outlet passage (not shown). The gaseous fuel is flowable from fuel manifold 220 through outlet passage into mixing chamber 216 of annular burner body 210.

As shown, burner body 210 has a vertical Venturi mixing tube 224. Venturi mixing tube 224 has an inlet 227 to a flow passage in fluid communication with the mixing chamber 216. Annular burner body 210 may include a plurality of Venturi mixing tubes 224 positioned at different locations along the circumferential direction C. For instance, the plurality of Venturi mixing tubes 224 may be substantially evenly spaced apart from one another. In various embodiments, the annular burner body includes two or more Venturi mixing tubes 224, such as three Venturi mixing tubes, or other appropriate quantity to provide a fuel-air mixture to mixing chamber 216.

Fuel manifold 220 forms a fuel chamber 229 through which a flow of gaseous fuel is received and provided to the burner body 210. The fuel chamber 229 may include an inlet at any appropriate location and an outlet opening. A fuel nozzle 225 may be positioned at and oriented towards an inlet of fuel chamber 229. The fuel nozzle may be connected to a supply line for gaseous fuel, such as propane or natural gas, and the gaseous fuel may flow from the fuel nozzle to the fuel chamber 229.

An outlet fuel nozzle (not shown) may be positioned at the outlet passage at the fuel manifold 220. The outlet fuel nozzle may form a vertical outlet fuel nozzle having a vertically positioned outlet opening. The gaseous fuel is received through the fuel chamber 229 and pushed out of the chamber 229 through the outlet passage. The gaseous fuel egressing the outlet passage may entrain air from the space between the outlet passage and Venturi inlet 227 at the vertical Venturi mixing tube 224, and the gaseous fuel may mix with the entrained air within vertical Venturi mixing tube 224. The mixture of the gaseous fuel and air may mix at mixing chamber 216 and egress through flame ports 214.

In certain embodiments, burner assembly 200 also includes an inlet passage 230. Inlet passages 230 extend downwardly (e.g., along the axial direction A) from the mixing chamber 216 towards fuel manifold 220. Each inlet passage 230 may form an outlet end of a respective Venturi mixing tube 224. Thus, the gaseous fuel-air mixture is flowable from Venturi mixing tube 224 into mixing chamber 216 through inlet passages 230.

In various embodiments, annular burner body 210 is suspended over fuel manifold 220. In particular, vertical Venturi mixing tubes 224 may extend (e.g., along the axial direction A) from annular burner body 210 toward fuel manifold 220 and suspend the annular burner body 210 over the outlet passages at the fuel manifold 220 (e.g., along the axial direction A). With annular burner body 210 suspended over fuel manifold 220, gaseous fuel flowed from the outlet passage at the fuel manifold 220 entrains air from an atmospheric pressure volume formed between the mixing tube inlet 227 and the fuel manifold outlet passage.

In some embodiments, annular burner body 210 may also include an annular burner cap 246. For instance, annular burner cap 246 may be positioned on annular burner head 242 such that annular burner cap 246 covers annular burner head 242. Annular burner cap 246 may reduce staining of annular burner base 240 or annular burner head 242. For example, annular burner cap 246 may include an enamel coating on an outer surface 248 of annular burner cap 246. For example, the enamel coating may face away from annular burner head 242 and be visible to a user of burner assembly 200 when burner assembly 200 is positioned on top panel 142. The enamel coating on annular burner cap 246 may be easier to clean than and less stainable by spills from cooking utensils than the cast metal of annular burner base 240 or annular burner head 242.

Referring now to FIGS. 3-15, in various embodiments, the burner assembly 200 includes a top panel 300 at which a puck 310 may be removably positioned. The puck 310 forms a domed projection 312 that may be positioned onto a top surface 302 of the top panel 300 and extending along the axial direction A toward the central combustion zone 212. The projection 312 may reduce the volume of the central combustion zone 212, such as relative to the top panel 300. Accordingly, less gaseous fuel may pool within the central combustion zone 212 prior to ignition of the gaseous fuel. The reduced pooling of fuel may reduce or eliminate an audible noise (e.g., "pop" sound) from occurring during ignition of the gaseous fuel.

Central combustion zone 212 may also be positioned concentrically with projection 312. For example, central combustion zone 212 and projection 312 may have a generally circular cross-section in a plane that is perpendicular to vertical, and the circular cross-sections of central combustion zone 212 and projection 312 may be positioned concentric with each other. Such positioning of central combustion zone 212 and projection 312 may cause the gaseous fuel within central combustion zone 212 to swirl above projection 312, and the swirling pattern may encourage the collected gaseous fuel to deflect out and away from central combustion zone 212. Thus, less gaseous fuel may pool within central combustion zone 212 prior to ignition of the gaseous fuel and the ignition "pop" noise may be reduced or eliminated.

As shown, annular burner body 210 may include an annular burner base 240 and an annular burner head 242. Annular burner base 240 includes inlet passages 230. Annular burner head 242 may be positioned on annular burner base 240 to form mixing chamber 216 of annular burner body 210. Thus, annular burner base 240 may form a bottom wall of mixing chamber 216, and annular burner head 242 may form a top wall of mixing chamber 216. Annular burner base 240 or annular burner head 242 may be formed of a cast metal, such as cast iron or cast aluminum alloy.

Burner head 242 includes a radial wall 241 extending over the mixing chamber 216. The radial wall 241 extends annularly, such as to form the top wall of mixing chamber 216. An annular outer wall 243 extends from the radial wall 241. The outer wall 243 may extend radially outside of the outer side wall 219. The outer wall 243 may include a surface at which the burner head 242 rests upon the burner base 240.

Figure 13:
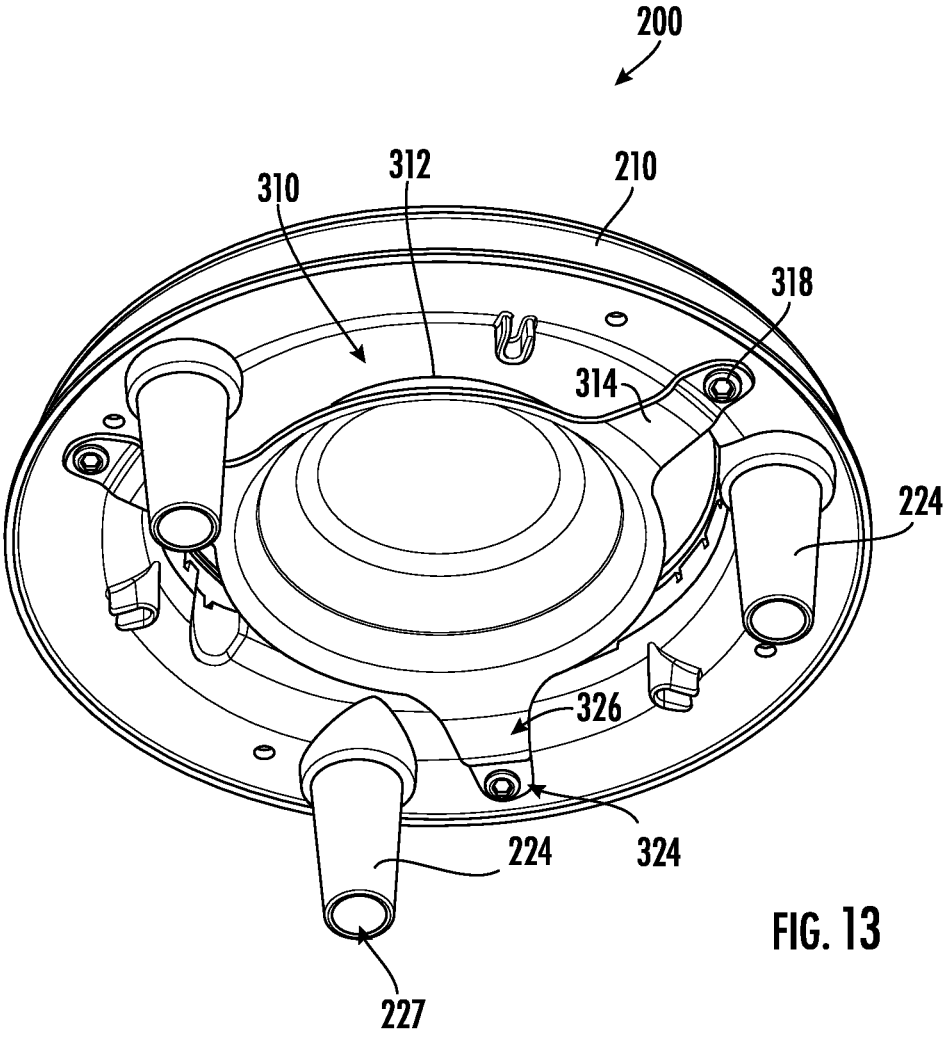
FIG. 13 provides a bottom-up perspective view of an embodiment of a burner assembly according to an exemplary embodiment of the present disclosure.
Figure 14:
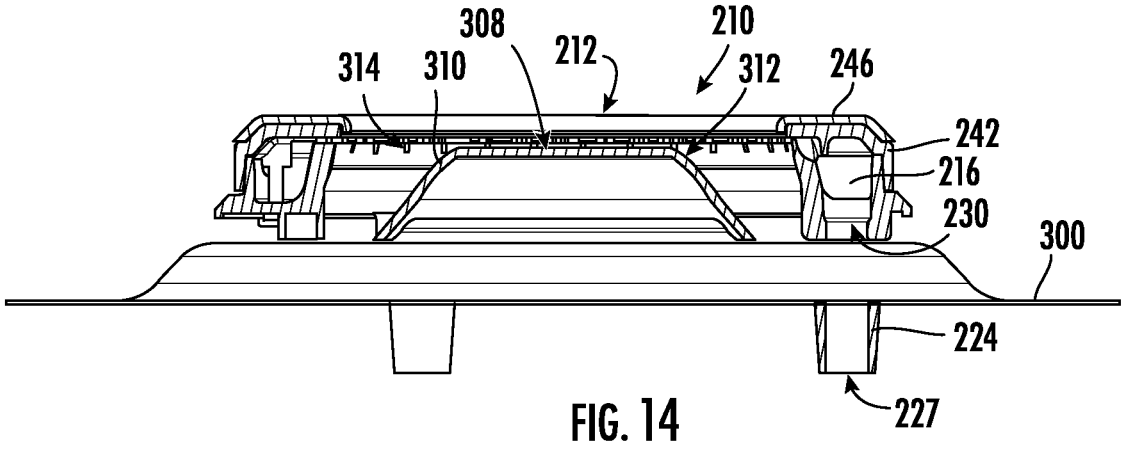
FIG. 14 provides a side view of an embodiment of a burner assembly according to an exemplary embodiment of the present disclosure.
Figure 15:
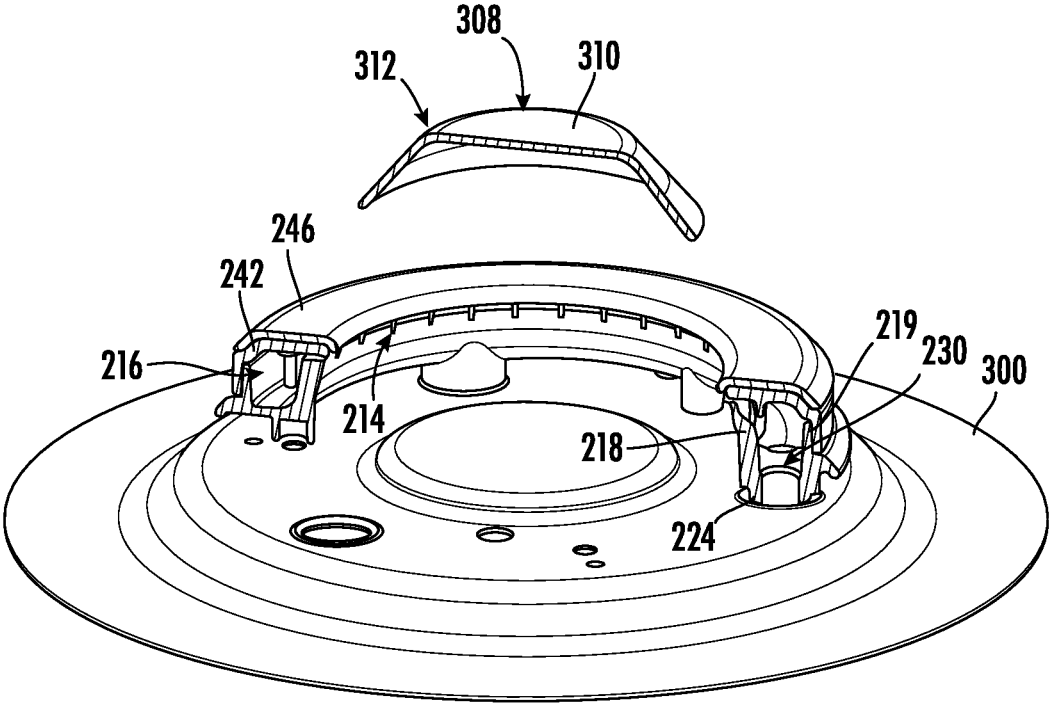
FIG. 15 provides an exploded cutaway perspective view of the embodiment of the burner assembly of FIG. 13 according to an exemplary embodiment of the present disclosure.

In some embodiments, such as depicted in FIGS. 14-15, the puck 310 may be selectively positioned onto the top panel 300. In various embodiments, such as depicted in FIGS. 3-13, the puck 310 is selectively fastened to the burner body 210, such as to allow a user or manufacturer to selectively install or remove the puck 310. For instance, a user may selectively remove the puck 310 to clean the puck 310, the top panel 300, or other surfaces around the burner assembly 200. In another instance, a manufacturer may selectively include the puck 310, or various configurations thereof, based on other configurations of the burner assembly 200 or range appliance 100, without requiring varying interfaces or attachments between the puck 310 and burner body 210.

In various embodiments, an arm 314 extends from the projection 312. An opening 316 is formed through the arm 314 to allow for a fastener 318 to extend therethrough. The opening 316 at the puck 310 may form a slot or elongated hole. For instance, the opening 316 may be elongated co-directional to an extension of the arm 314 along the radial direction R. The opening 316 may form, at least in part, a radial gap 328 such as further described below.

The arm 314 may include an end portion 324 distal to the projection 312. The opening 316 may extend through the end portion 324 of the arm 314. In some embodiments, the end portion 324 is offset along axial direction A from an intermediate portion 326. For instance, the end portion 324 may be positioned upward or more proximate along the axial direction A than the intermediate portion 326.

The annular burner base 240 includes an opening 221 to allow the fastener 318 to extend therethrough. The annular burner head 242 may form an opening 223 to allow the fastener 318 to extend thereinto. For instance, the opening 223 may be formed through the radial wall 241 extending over the mixing chamber 216. In various embodiments, the fastener 318 extends through the arm 314 at the puck 310, the burner base 240 at the burner body 210, and the burner head 242. In some embodiments, the fastener 318 extends into the mixing chamber 316. However, it should be appreciated that the fastener 318 may extend into a wall adjacent to or forming the mixing chamber 316, such as outer wall 243. One or more openings, 316, 221, 223 may include threads, such as to allow fastener 318 to thread into or through one or more of the base 240, the head 242, or the puck 310. Accordingly, the fastener 318 may couple together the base 240, the head 242, and the puck 310.

In various embodiments, raised material 320, such as a neck or shoulder, extends between a head 319 of the fastener 318 and a bottom surface 239 of the burner base 240. The raised material 320 may form a neck or shoulder that forms an axial gap 322 between the head 319 and the end portion 324 of the arm 314 along the axial direction A. For instance, the raised material 320 may form a shoulder extending greater along the axial direction A than a thickness of the end portion 324 of the arm 314. In still some embodiments, the opening 316 is formed greater than the raised material 320 such as to form the radial gap 328 between the raised material 320 and faces at the end portion 324 forming the opening 316 along the radial direction R. One or both of the gap 322, 328 may allow for desired positioning, expansion, or contraction of the puck 310 at the burner assembly 200.

Figure 7:
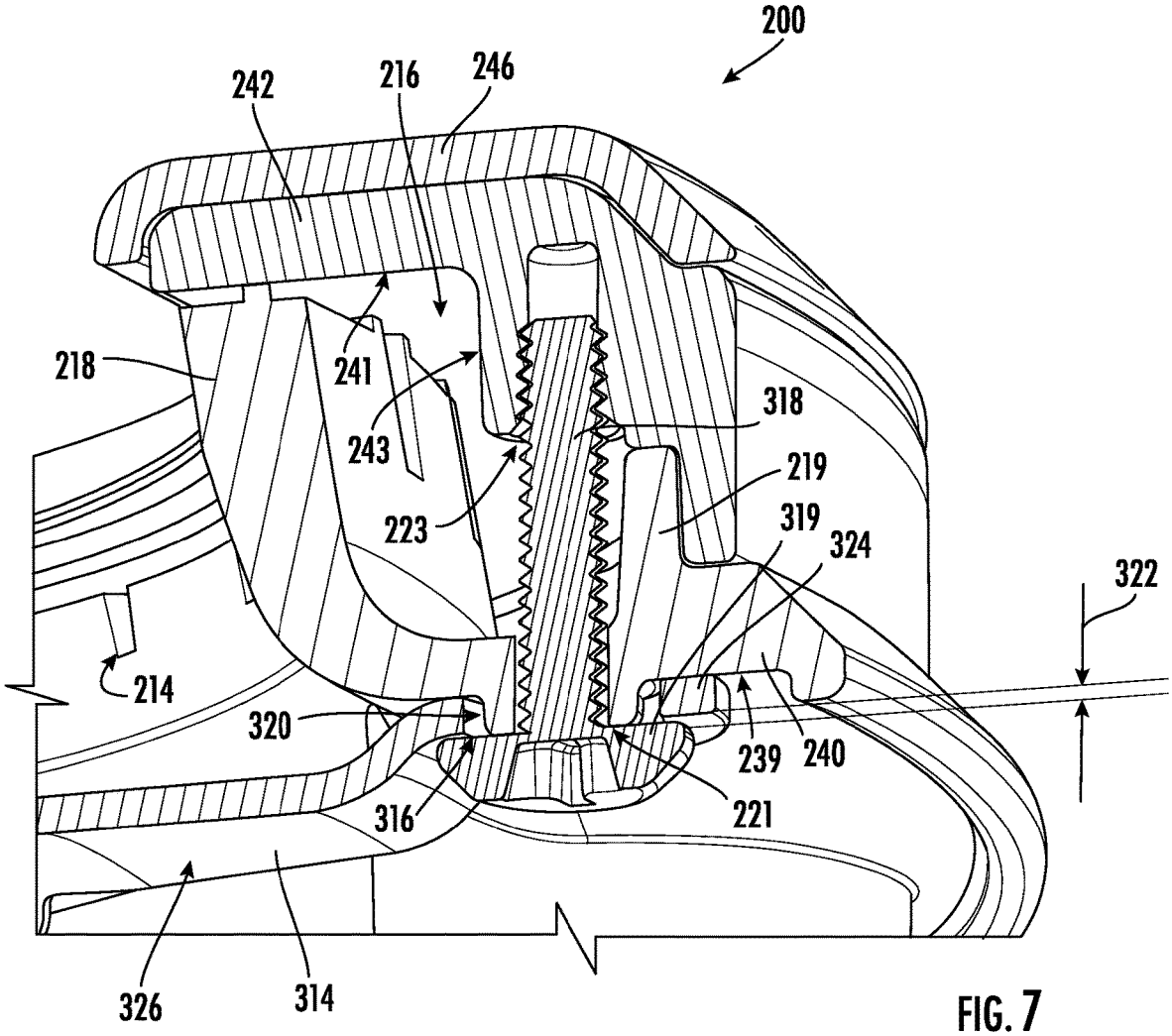
FIG. 7 provides a detailed cutaway-perspective view of an embodiment of a burner assembly according to an exemplary embodiment of the present disclosure.
Figure 8:
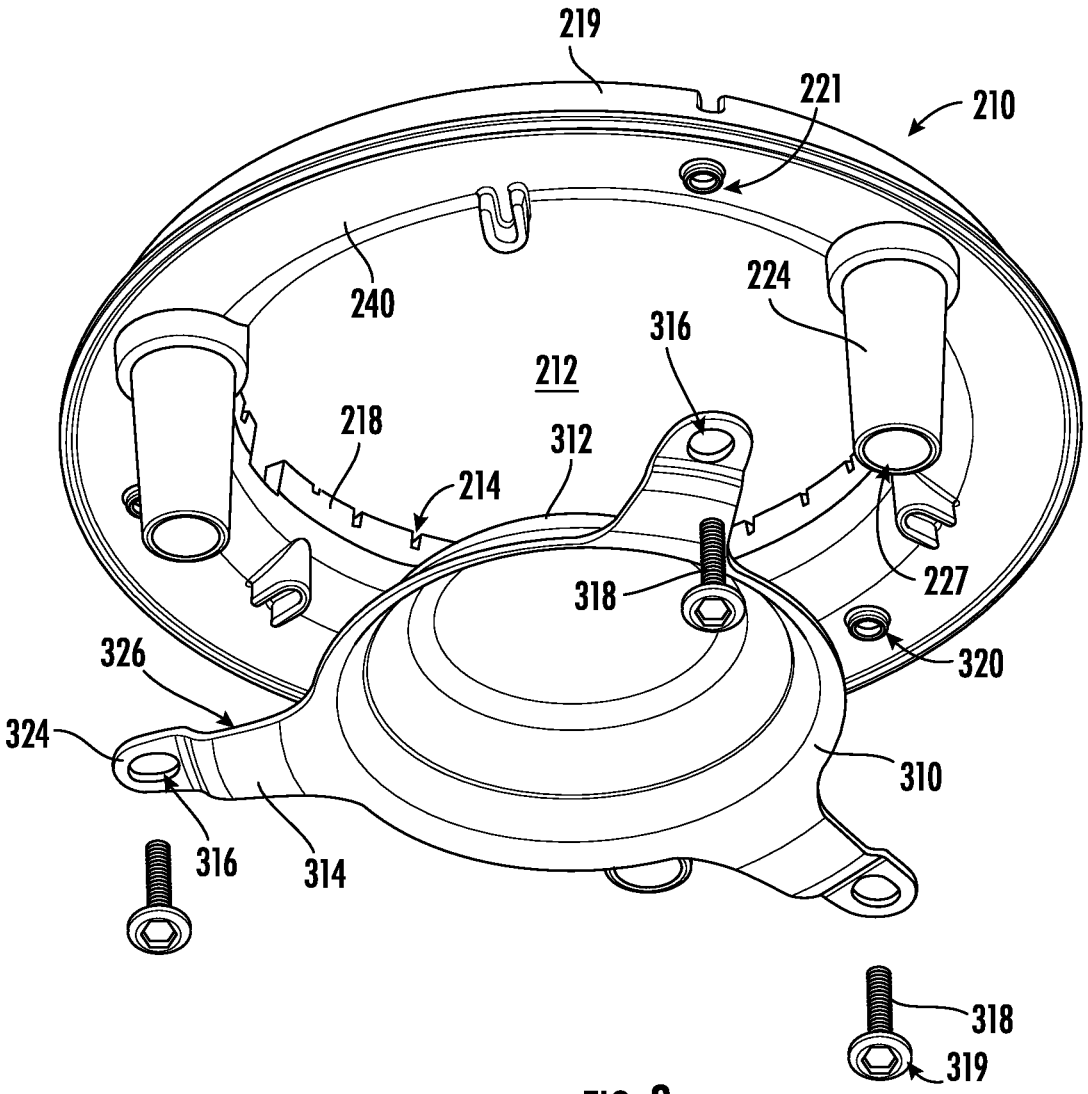
FIG. 8 provides an exploded bottom-up perspective view of an embodiment of the burner assembly of FIG. 7 according to an exemplary embodiment of the present disclosure.
Figure 9:
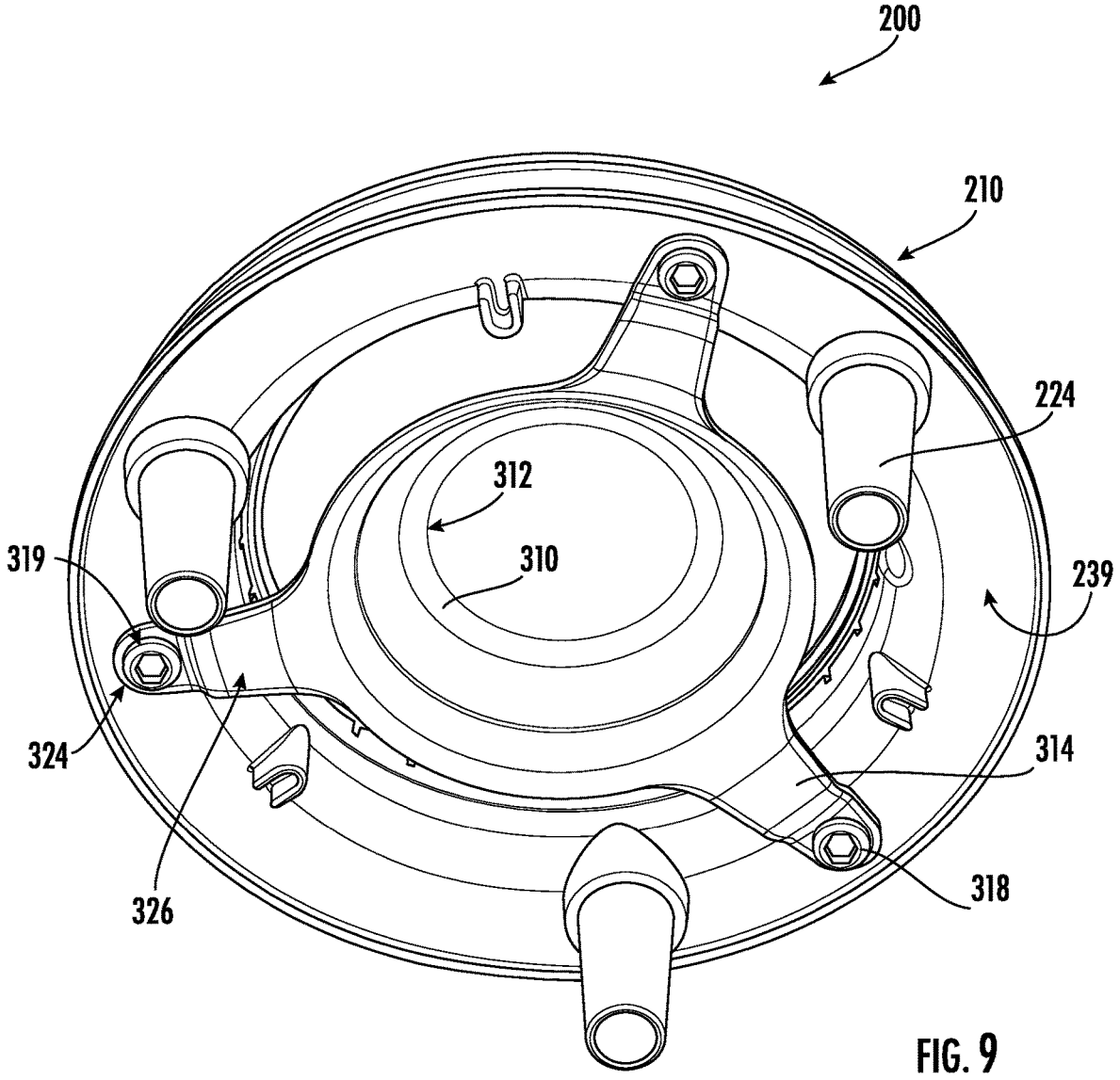
FIG. 9 provides a bottom-up perspective view of the embodiment of the burner assembly of FIG. 8 according to an exemplary embodiment of the present disclosure.

In some embodiments, such as depicted in FIGS. 7-8, the raised material 320 is formed extending from the bottom surface 239 of the burner base 240 (e.g., integral to the burner base 240). For instance, fastener 318 may include a threaded shank extending from the head 319. A bottom surface 239 of the head 319 may rest upon the raised material 320 extending from the burner base 240.

Figure 10:
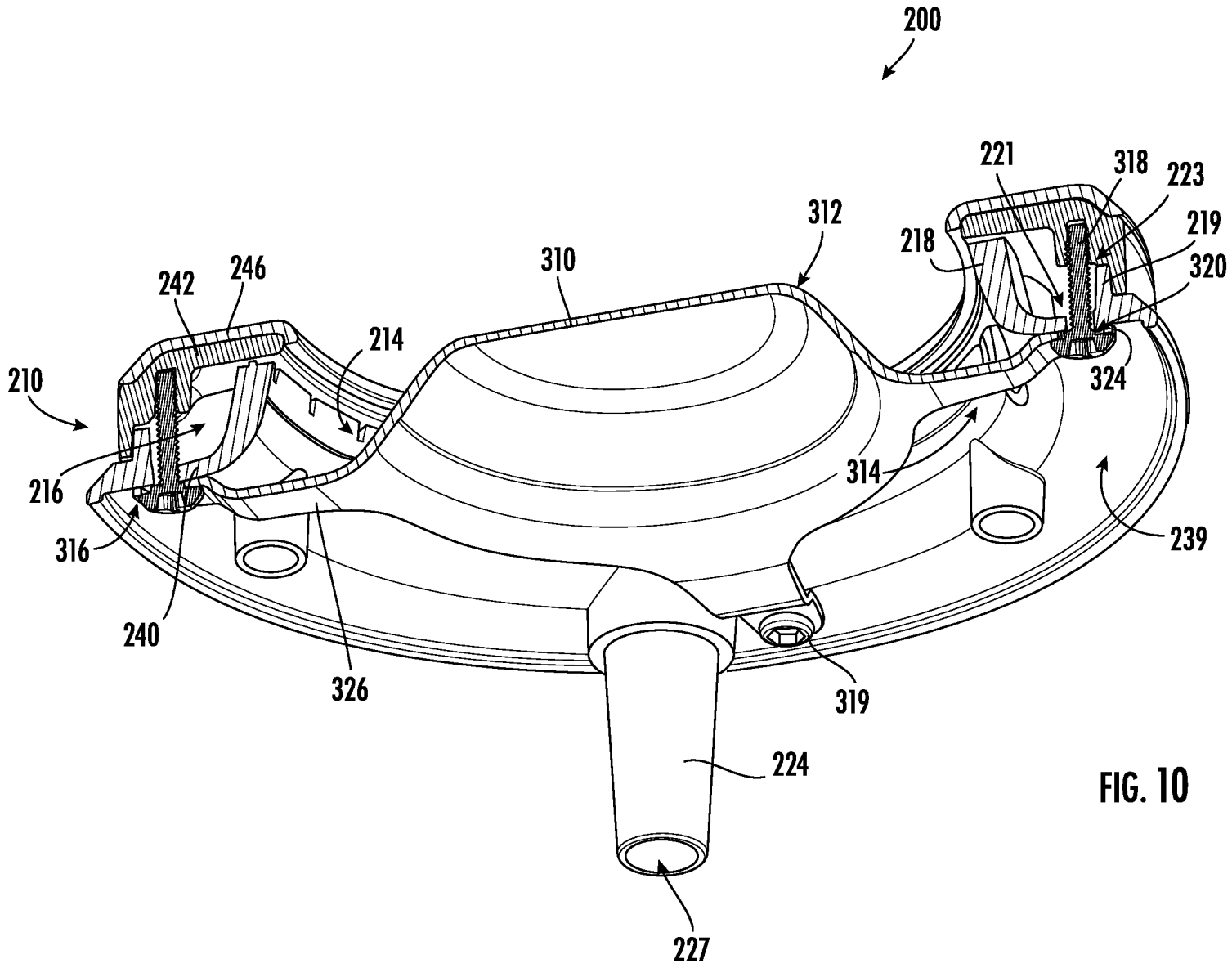
FIG. 10 provides a cutaway perspective view of an embodiment of a burner assembly according to an exemplary embodiment of the present disclosure.
Figure 11:
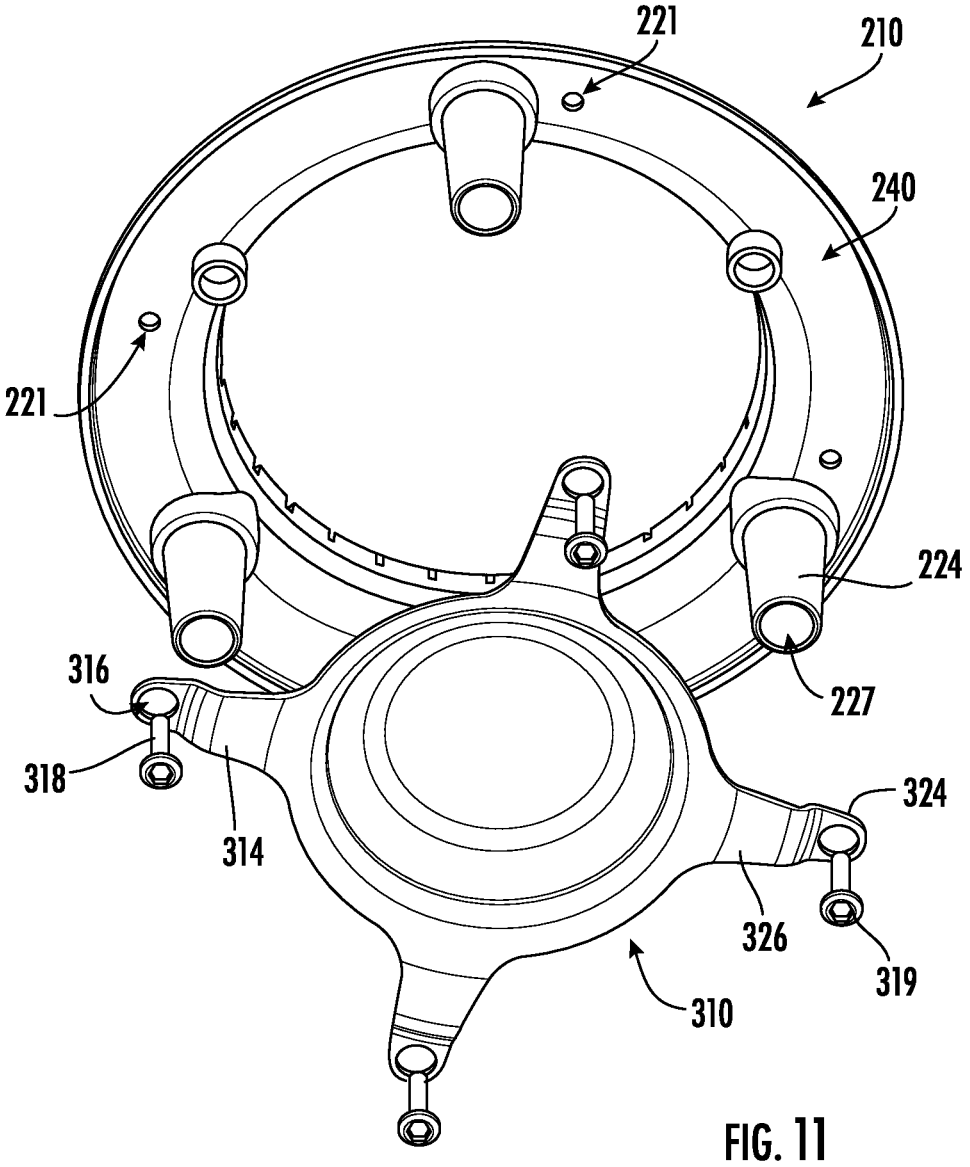
FIG. 11 provides an exploded bottom-up perspective view of the embodiment of the burner assembly of FIG. 10 according to an exemplary embodiment of the present disclosure.
Figure 12:
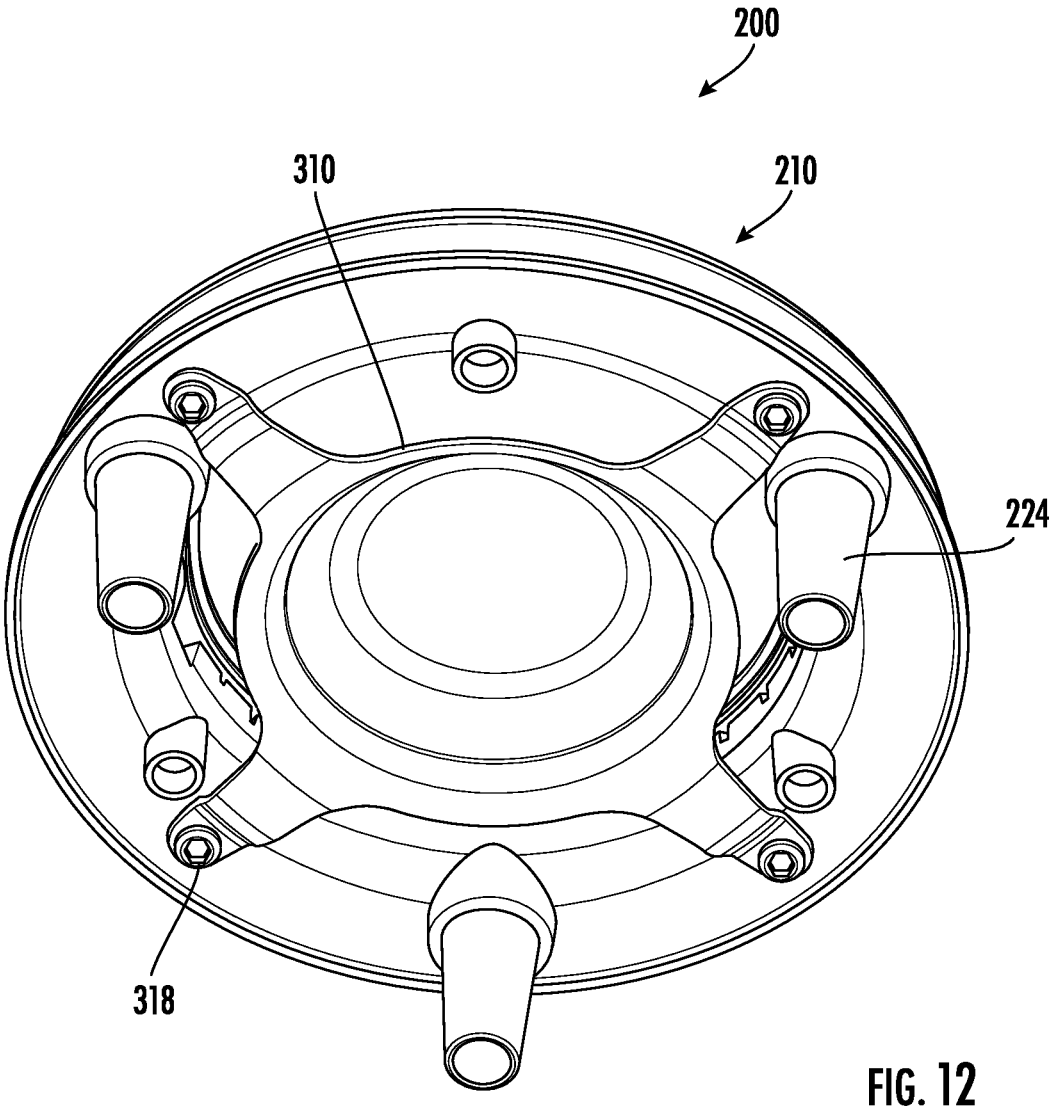
FIG. 12 provides a bottom-up perspective view of the embodiment of the burner assembly of FIG. 10 according to an exemplary embodiment of the present disclosure.

In still some embodiments, such as depicted in FIGS. 10-11, the raised material 320 is formed extending from the head 319 of the fastener 318. For instance, the raised material 320 may form a shoulder extending from the head 318 toward the threaded shank of the fastener, such as a shoulder screw, or other appropriate threaded fastener.

It should be appreciated that various types of fastener 318 may be included to couple the puck 310 to the burner base 240 and burner head 242. For instance, as depicted and described above, the fastener 318 may include a threaded fastener, such as, but not limited to, a screw or bolt, or, such as described above, a shoulder screw or other fastener including a raised material between the head and bottom surface of the burner base. In still some embodiments, such as depicted in FIG. 13, the fastener 318 may include a rivet. It should be appreciated that the fastener 318 including the raised material 320, or the raised material 320 extending from the burner base 240, may allow for relatively simple, low-cost, design and assembly. Embodiments of the puck 310 may allow a user to selectively apply or remove the puck 310.

Embodiments of the burner assembly 200 including embodiments of the puck 310 separable from the top panel 300 allows for the puck 310 to have separate materials, coatings, or geometries independent of the top panel 300. For instance, the puck 310 may include a thermal coating or enamel that may be more suitable or cost-effective than an integral top panel and puck. In some embodiments, the puck 310 includes a first thermal coating different from a second thermal coating at the top panel 300. The separable puck 310 allows for geometries independent of the top panel 300, such as, but not limited to, taller protrusion 312 (e.g., greater height along the axial direction A from the top panel 300), such as to allow the protrusion 312 to extend further into the central combustion zone 212 and more effectively reduce or eliminate pooling of gaseous fuels. For instance, in various embodiments, a top surface 308 of the projection 312 is co-planar or higher along the axial direction A to one or more of the plurality of flame ports 214.

Embodiments of the puck 310 may be configured to address issues related to material thermal expansion mismatch (e.g., differences in coefficient of thermal expansion between one or more of the puck 310, the burner body 210, or the top panel 300). For instance, the raised material 320 at the fastener 318 or burner base 240 may allow for relative movement between the puck 310 and the burner body 210.

Embodiments of the burner assembly 200 including the puck 310 may provide improved reduction or elimination of ignition noise by allowing for protrusions 312 with greater heights, while further allowing for thermal coatings at the puck 310, or particularly the protrusion 312, different from a thermal coating at the top panel 300, such as may be more appropriate for greater heat loads related to greater protrusion into the central combustion zone 212.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel comprising a top surface;

a gas burner assembly positioned at the top panel, the gas burner assembly comprising;

an annular burner body positioned at the top surface of the top panel, the annular burner body forming a central combustion zone, a plurality of flame ports at the central combustion zone, and an annular mixing chamber upstream from the plurality of flame ports to permit a fuel-air mixture to flow into the central combustion zone through the plurality of flame ports;

an annular burner base forming a bottom wall of the mixing chamber; and an annular burner head forming a top wall of the mixing chamber; and a puck comprising a domed projection separably positioned at the top surface of the top panel and extending toward the central combustion zone, wherein the puck comprises an arm extending from the projection, wherein a first opening is positioned through the arm to allow a fastener to extend therethrough into a second opening at the burner base, wherein a raised material extends between a head of the fastener and a bottom surface of the burner base.

2. The cooktop appliance of claim 1, wherein a third opening is formed at the burner head, and wherein the fastener is extendable into the first opening, the second opening, and the third opening to couple the puck to the burner body, the burner base, and the burner head.

3. The cooktop appliance of claim 2, wherein the third opening is formed at an outer wall of the burner head.

4. The cooktop appliance of claim 1, wherein the first opening is an elongated hole extending co-directional to an extension of the arm along a radial direction.

5. The cooktop appliance of claim 1, wherein the first opening is positioned at an end portion of the arm distal to the projection along a radial direction.

6. The cooktop appliance of claim 1, wherein the arm at the puck comprises an intermediate portion and an end portion distal to the projection along a radial direction, wherein the end portion is positioned upward along an axial direction relative to the intermediate portion.

7. The cooktop appliance of claim 1, wherein the raised material extends along an axial direction greater than a thickness of an end portion of the arm to form an axial gap between the head of the fastener and the end portion of the arm.

8. The cooktop appliance of claim 1, wherein a radial gap is formed between the raised material and faces at an end portion of the arm forming the opening.

9. The cooktop appliance of claim 1, wherein the raised material is formed extending from the head of the fastener.

10. The cooktop appliance of claim 1, wherein the raised material is formed extending from the bottom surface of the burner base.

11. The cooktop appliance of claim 1, wherein the fastener is a rivet.

12. The cooktop appliance of claim 1, wherein the puck comprises a first thermal coating different from a second thermal coating at the top panel.

13. The cooktop appliance of claim 1, wherein a top surface of the projection is co-planar to one or more of the plurality of flame ports.

14. A gas burner assembly for a cooktop appliance, the gas burner assembly comprising:

an annular burner body forming a central combustion zone, a plurality of flame ports at the central combustion zone, and an annular mixing chamber upstream from the plurality of flame ports to permit a fuel-air mixture to flow into the central combustion zone through the plurality of flame ports;

an annular burner base forming a bottom wall of the mixing chamber;

an annular burner head forming a top wall of the mixing chamber; and a puck comprising a domed projection separably positioned at a top surface of a top panel and extending toward the central combustion zone, wherein the puck comprises an arm extending from the projection, wherein a first opening is positioned through the arm to allow a fastener to extend therethrough into a second opening at the burner base, wherein a third opening is formed at an outer wall of the burner head, and wherein the fastener is extendable into the first opening, the second opening, and the third opening to couple the puck to the burner body, the burner base, and the burner head.

15. The gas burner assembly of claim 14, wherein the arm at the puck comprises an intermediate portion and an end portion distal to the projection along a radial direction, wherein the end portion is positioned upward along an axial direction relative to the intermediate portion.

16. The gas burner assembly of claim 14, wherein a raised material extends between a head of the fastener and a bottom surface of the burner base.

17. The gas burner assembly of claim 14, wherein the first opening is an elongated hole extending co-directional to an extension of the arm along a radial direction.

18. The gas burner assembly of claim 14, wherein the first opening is positioned at an end portion of the arm distal to the projection along a radial direction.

19. The gas burner assembly of claim 14, wherein the puck comprises a first thermal coating different from a second thermal coating at the top panel.

20. The gas burner assembly of claim 14, wherein a top surface of the projection is co-planar to one or more of the plurality of flame ports.

* * * * *